United States Patent [19]

Schmutzler

[11] Patent Number: 4,993,758

[45] Date of Patent: Feb. 19, 1991

[54] LATCHING APPARATUS FOR A DOOR AND OTHER MEMBERS

[75] Inventor: Richard W. Schmutzler, Walton, N.Y.

[73] Assignee: Databook, Inc., Ithaca, N.Y.

[21] Appl. No.: 354,793

[22] Filed: May 22, 1989

[51] Int. Cl.[5] ..... E05C 1/08

[52] U.S. Cl. ..... 292/152; 292/DIG. 38

[58] Field of Search ..... 292/152, 153, 175, DIG. 38, 292/163, 180; 70/DIG. 6

[56] References Cited

U.S. PATENT DOCUMENTS

| | | | |
|---|---|---|---|
| 310,787 | 1/1885 | Buckley et al. | 292/152 X |
| 1,103,701 | 7/1914 | Squiller | 292/152 X |
| 2,280,084 | 4/1942 | Segal | 292/152 |
| 3,671,065 | 6/1972 | Bingham | 292/175 |
| 4,377,303 | 3/1983 | McPherson | 292/152 |
| 4,400,026 | 8/1983 | Brown, Jr. | 292/152 X |

*Primary Examiner*—Richard E. Moore

[57] ABSTRACT

A housing closure apparatus for latching a swingable door which covers an opening in a housing. The housing closure apparatus includes a latching mechanism having a latch guide structure with a channel therein for captivating a slidable latch. A latch receiving member is situated on the housing to receive a portion of the latch therein to latch the door closed. In one embodiment of the invention, the latch mechanism exhibits a dual locking capability such that the latch is lockable in a latch closed position against undesired opening due to shock and vibration, and is further lockable in a latch open position.

4 Claims, 8 Drawing Sheets

LATCHING APPARATUS FOR A DOOR AND OTHER MEMBERS

BACKGROUND OF THE INVENTION

This invention relates in general to an apparatus for latching and unlatching first and second members, and more particularly, to an apparatus for latching and unlatching a hinged door.

BRIEF SUMMARY OF THE INVENTION

It is often desirable to provide a door with a latching mechanism for maintaining the door in a closed position and yet to permit the door to be readily unlatched for opening.

One such latching mechanism is the familiar rotating door knob which engages a slidable bolt situated within the door. The bolt extends from the door to mate with an opening in a door jamb to hold the door in a closed position. When the knob is rotated, the bolt is withdrawn from the opening in the jamb to permit the door to be swung open.

Another latching mechanism is the familiar hook and eye arrangement in which a hook member is attached to a stationary member in a position so as to be latchable with an eye member situated on a swingable door.

Yet another latching mechanism is the hasp/staple arrangement. A hasp is a hinged metal fastener which is mountable at the edge of a door. The hasp includes a slot which passes over a staple mounted on a stationary structure adjacent the edge of the door. To lock the door in position, a padlock is typically inserted through the staple after the hasp is passed over the staple.

Still yet another latching mechanism is the slide action bolt which is mountable at the edge of a door. To lock a door using this arrangement, the user manually rotates the bolt to a release position and then slides the bolt horizontally until the end of the bolt is engaged in and held by a retainer mounted to a stationary structure adjacent the edge of the door.

Unfortunately, many of these conventional latching mechanisms are not readily adaptable to miniaturization. That is, in some prior latch mechanisms, the user must grasp the latch securely with multiple fingers to achieve latch operation. This is a serious disadvantage in the miniature housings which are often used in modern electronic equipment. Another problem with past door latching mechanisms is that some are not vibration or shock resistant, while others, like the bolt action door latch described above require a complicated mechanism and a twisting or rotating motion for operation.

Accordingly, one object of the present invention is to provide a latching mechanism for latching and unlatching a swingable hinged door which is simple to use and which does not require complex hand manipulations.

Another object of the present invention is to provide a latching apparatus with an easy to use locking feature to permit the user to easily lock the latch in a closed position against undesired opening due to shock and vibration.

Yet another object of the invention is to provide a latching mechanism which is readily subject to miniaturization.

In accordance with the present invention, a housing closure apparatus is provided including a housing having an opening and further including a door having first and second opposed surfaces, the door being swingably mounted on the housing such that the first surface covers the opening when the door is closed, the door exposing the opening when the door is swung open. The apparatus further includes a latch guide structure situated on the second surface of the door, the latch guide structure including a channel therein. A latch receiving member is situated on the housing at a location adjacent the latch guide structure when the door is in the closed position. In one embodiment of the invention, a slidable latch is situated within the channel and includes a locking structure for lockably engaging the latch guide structure in a first locked position when the latch is urged to extend into the latch receiving member. In another embodiment of the invention, a slidable latch is situated within the channel and includes a locking structure for lockably engaging the latch guide structure in a first locked position when the latch is urged to extend into the latch receiving member and for lockably engaging the latch guide structure in a second locked position when the latch is urged to disengage the latch receiving member.

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

Figure 1:
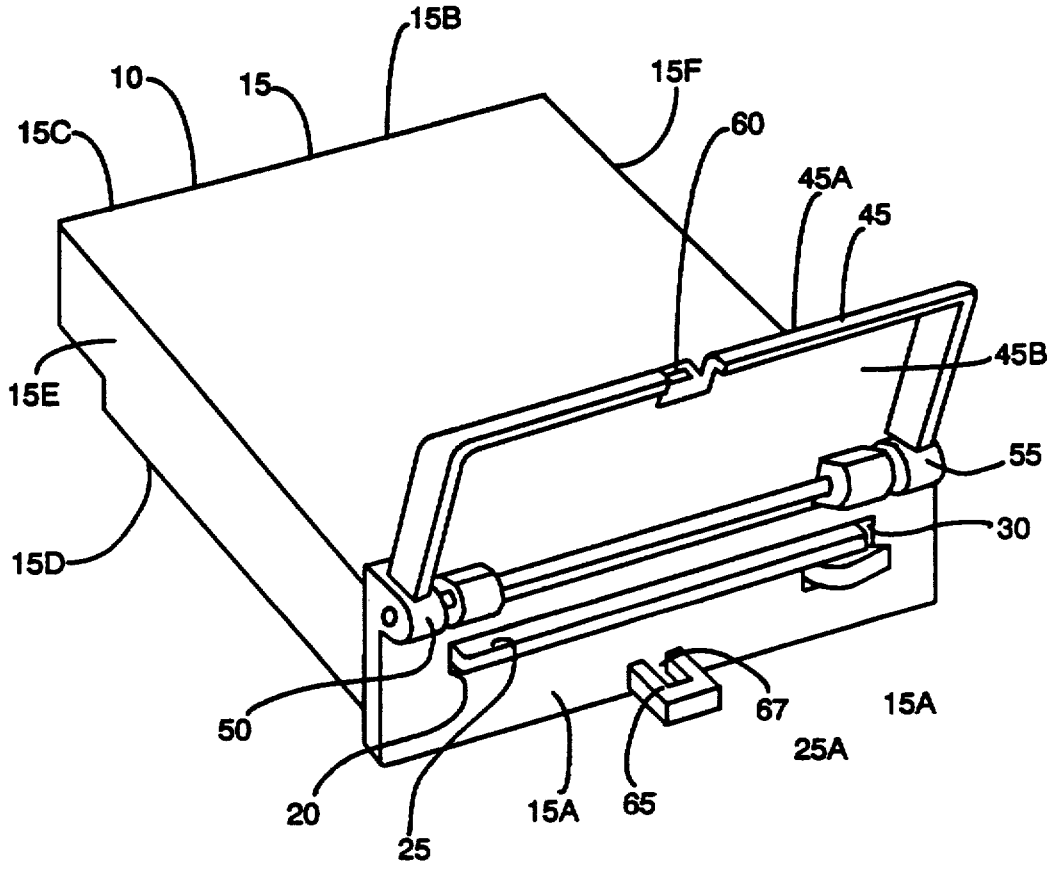
FIG. 1 is a perspective view of a housing closure apparatus showing an open access door with a latch mechanism in the open position in accordance with the present invention.

In accordance with one embodiment of the present invention, FIG. 1 shows a memory module receiving apparatus 10 including a housing 15 having an opening 20 therein which is shaped for receiving an electronic module 25. Opening 20 communicates with a chamber 30 which is situated within housing 15 and which receives module 25 when module 25 is passed through opening 20. Chamber 30 exhibits a geometry which is appropriately shaped to accommodate module 25 therein.

In this particular embodiment of the invention, module 25 is shaped substantially in the profile of a credit card and includes a nonvolatile memory. For example, one memory cartridge which may be employed as module 25 is the Model No. RBC008IE00 memory cartridge manufactured by Epson Corporation. The Epson memory cartridge includes 8K bytes or more of static random access memory (SRAM) which is backed up by a lithium battery to preserve data when data is stored in the cartridge. Of course, memory cartridges with memory capacities other then 8K bytes may also be used with the present invention.

In this document, module 25 is alternatively referred to as memory cartridge 25. The rear edge surface of cartridge 25, that is, the edge surface distal from front edge 25A seen in FIG. 1 includes a plurality of connecting pins or conductors (not shown) which mate with a connector (also not shown) housed within housing 15 of apparatus 10. The connector provides mechanical seating for module 25 and is coupled to electronic circuitry (not shown) for which connection to module 25 is desired. Thus, when module 25 is inserted into opening 20 of housing 15 and when module 25 is mated with the connector therein, module 25 is electrically coupled to the aforementioned electronic circuitry. In this manner, the various memory circuits or other circuits within module 25 are coupled to the aforementioned electronic circuitry as desired. Other similar modules 25 can be interchangeably inserted into and operated within housing 15 in the normal use of apparatus 10.

After module 25 is inserted into housing 15 of apparatus 10, hinged door 45 may be closed to provide a gasket-sealed (gasket shown later in FIG. 7), substantially dust free and moisture resistant environment within housing 15 for the operation of apparatus 10 in combination with removable module 25. The nature of module 25 as well as its insertion and extraction from chamber 30 of housing 15 and the nature of the gasket-sealing arrangement are discussed in more detail in my copending patent applications entitled, "Apparatus And Method For Extracting An Electronic Circuit Module From A Housing," Ser. No. 07/354,720, filed May 22, 1989 and "Storage Media Drive Apparatus With Readily Accessible Electrical Characteristic Selection Capability," Ser. No. 07/354,744, filed May 22, 1989.

FIG. 1 further shows door 45 in the open position with a module 25 inserted in module receiving apparatus 10. In more detail, door 45 is mounted to housing 15 via hinges 50 and 55 which are situated at the opposite ends of front surface 15A and are further situated above opening 20. Door 45 is swung downwardly to cover front surface 15A of housing 15 both when module receiving apparatus 10 contains a module inserted therein as well as when no module is inserted in apparatus 10.

A gasket (shown later in FIG. 7) is mounted on inside surface 45B of door 45 so that when door 45 is closed, chamber 30 is sealed from moisture and external contaminants in the environment. When door 45 is swung downwardly to the closed position, a slidable latch 60 (partially shown in FIG. 1) is mated with a latch receiving member 65 to hold door 45 closed. In this particular embodiment of the invention, latch receiving member 65 is seen to be generally U shaped with the ends of the U attached to the lower portion of front surface 15A of housing 15. Latch receiving member 65 includes an opening 67 for receiving slidable latch 60 as will be described later in more detail. In this embodiment, latch receiving member 65 is formed from the same material as housing 15 and is integrally molded as part of housing 15. It will be appreciated however that latch receiving member 65 may also be formed separately from housing 15 and may be mounted on housing 15 via an adhesive, a screw mount or other attachment.

Figure 2:
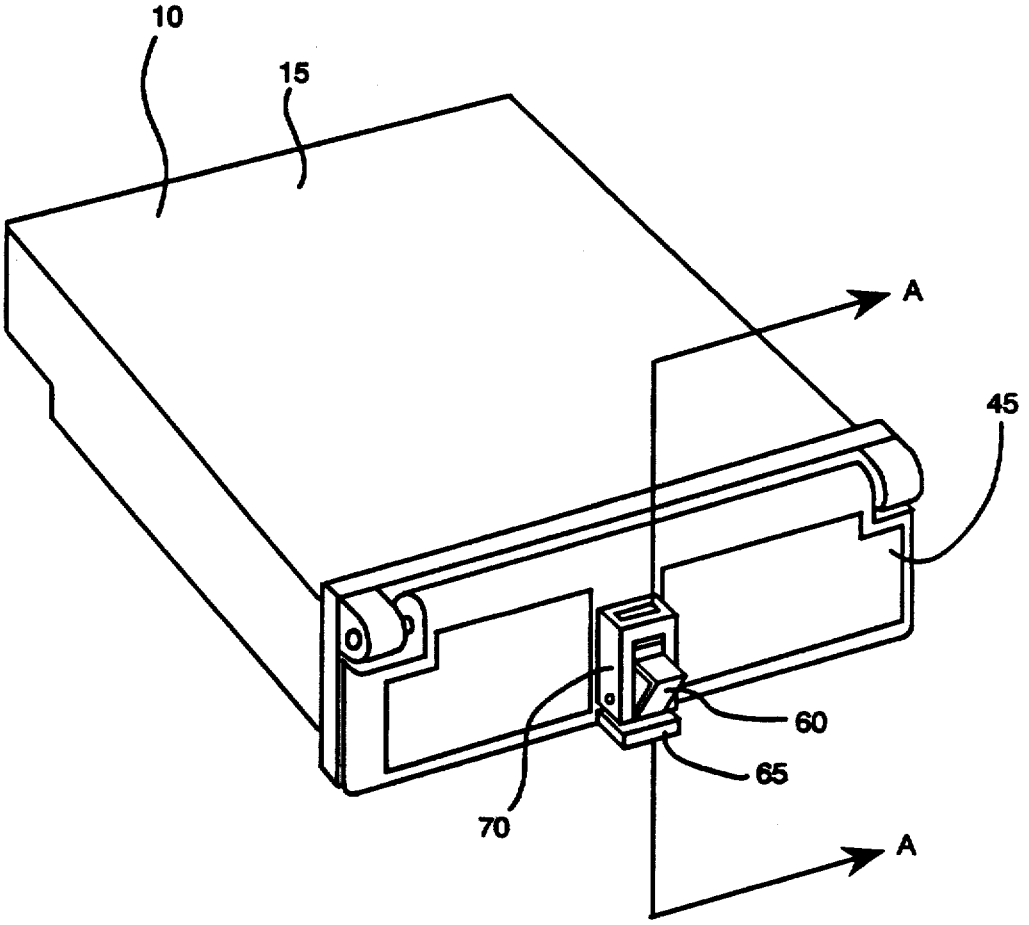
FIG. 2 is a perspective view of the housing closure apparatus of FIG. 1 with the access door swung closed and with the latch mechanism in a locked position.

FIG. 2 shows a perspective view of housing 15 of apparatus 10 with hinged door 45 closed and with slidable latch 60 in a locked position engaging latch receiving member 65. Slidable latch 60 slides within latch guide way 70. As will be described later, when slidable latch 60 is engaged, that is when slidable latch 60 mates with latch receiving member 65, a retaining feature is employed to keep the engaged latch securely locked. The retaining feature resists shocks, vibrations and other movements which may otherwise cause latch 60 to inadvertently retract from latch receiving member 65 and cause hinged door 45 to swing open unintentionally. Operation of latch mechanism 60, as will be explained subsequently, requires that a force be applied to latch 60 in order to release the retaining feature.

Figure 3:
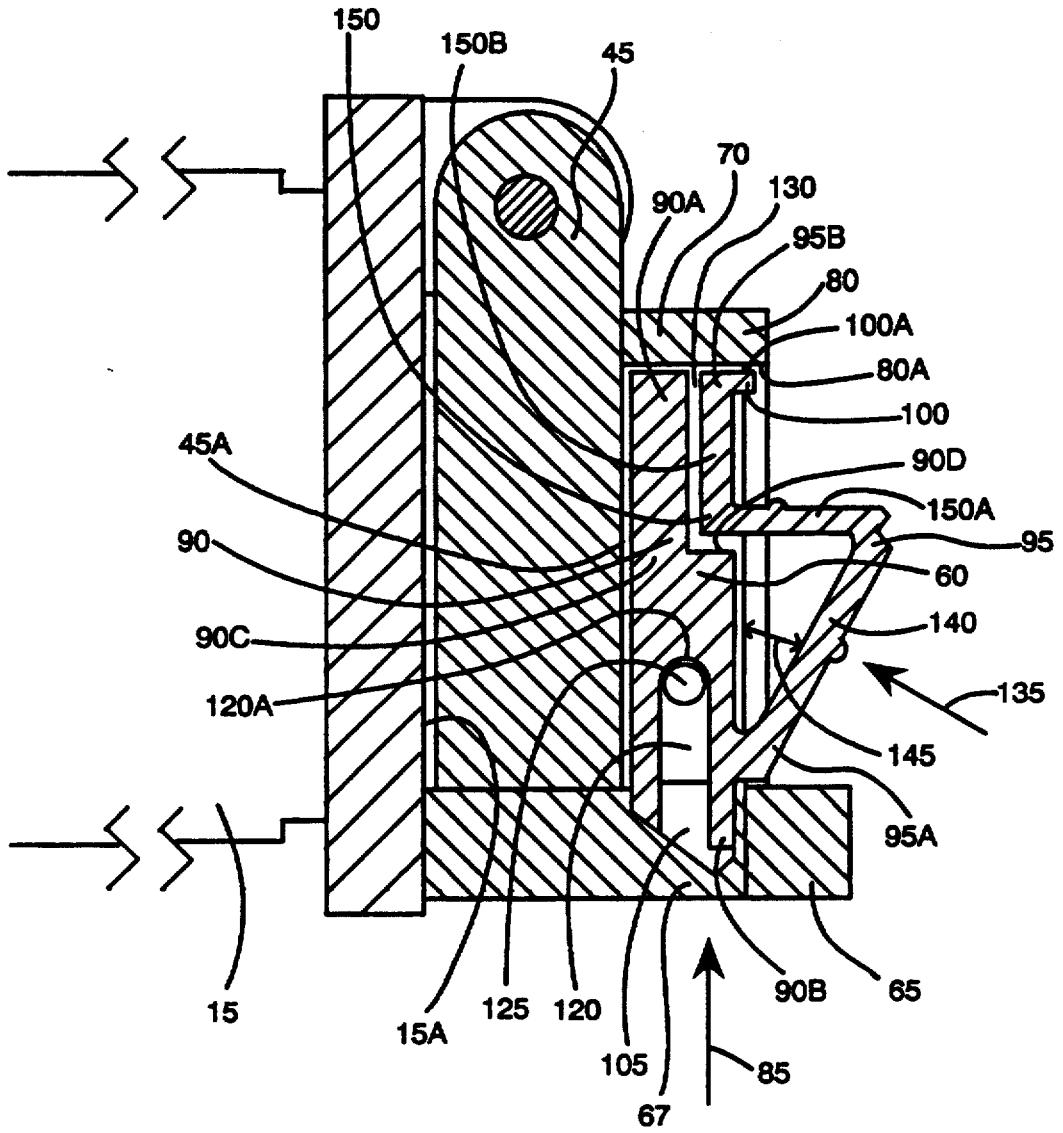
FIG. 3 is a sectional view of the latch mechanism with the latch in the closed locked position, the section being taken at line A—A of FIG. 2.

FIG. 3 depicts a cross-sectional view of the forward portion of module receiving apparatus 10 of FIG. 2 taken along section line A—A. Slidable latch 60 and latch receiving member 65 are readily observed in FIG. 3 in which latch 60 is shown engaged with latch receiving member 65 which is situated on front surface 15A of housing 15 of apparatus 10. That is, hinged door 45 is shown swung closed against front surface 15A of housing 15 and slidable latch 60 is shown engaging latch receiving member 65 so that hinged door 45 is locked in a closed position.

Returning momentarily to FIG. 1, it is seen that in this particular embodiment of the invention, housing 15 exhibits a generally rectangular parallelepiped shape. Housing 15 includes front and back surfaces, 15A and 15B, respectively. Housing 15 further includes top and bottom surfaces, 15C and 15D, respectively, as well as opposed side surfaces 15E and 15F. In the view of FIG. 1, back surface 15B, bottom surface 15D, and side surface 15F are partially hidden from view. The latching mechanism disclosed herein may be employed on housings and structures having geometries other than the particular geometry of housing 15 of FIG. 1.

Figure 4:
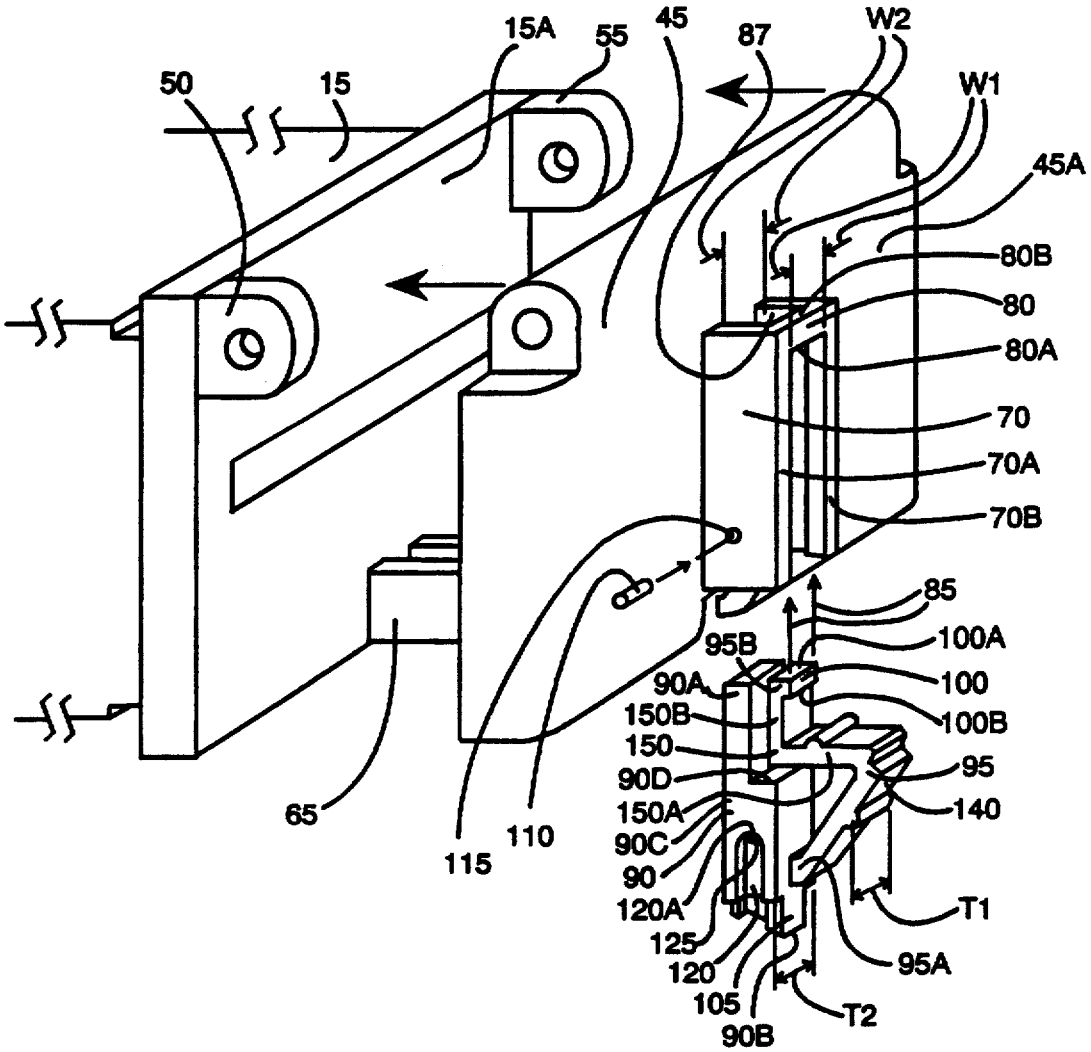
FIG. 4 is an exploded perspective view of the latch mechanism.

FIG. 4 shows an exploded view of the front surface 15A of housing 15 including hinged door 45 and the latch mechanism which will now be described. Hinged door 45 includes a latch guide way 70 which further includes left latch guide 70A, right latch guide 70B and a cross member 80 at one end of latch guide way 70. Latch guides 70A and 70B may alternatively be referred to as guide rails 70A and 70B.

Figure 5:
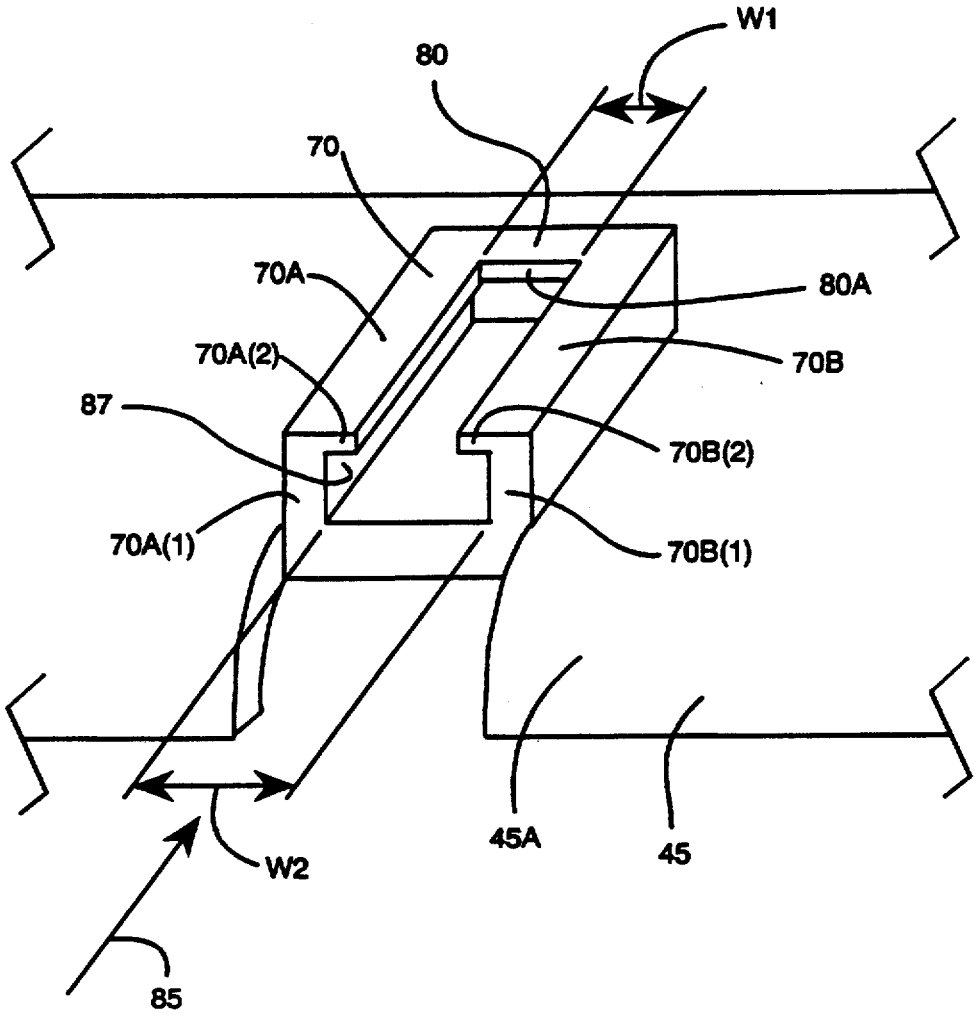
FIG. 5 is a perspective view of a latch guide way on an access door in accordance with the present invention.

Latch guide way 70 is detailed in FIG. 5 which shows a portion of hinged door 45 on which latch guide way 70 is disposed. As shown in FIG. 5, left latch guide 70A and right latch guide 70B are both shaped like inverted L's in their cross sections when viewed along the direction of arrow 85 on the front surface 45A of door 45. In that view, left latch guide 70A is an inverted backwards L and right latch guide 70B is an inverted L. In the meaning required here, inverted L refers to an L figure that is rotated 180 degrees in the plane of the L figure. Likewise, backwards inverted L refers to a backwards L figure that is rotated 180 degrees in the plane of the L figure.

More specifically, the L-shaped geometry of left latch guide 70A includes a leg portion 70A(1) and a foot portion 70A(2). The L-shaped geometry of right latch guide 70B includes a leg portion 70B(1) and a foot portion 70B(2). Latch guides 70A and 70B are mounted substantially parallel with each other on the front surface 45A of door 45, with leg portions 70A(1) and 70B(1) contacting surface 45A and with the foot portions 70A(2) and 70B(2) facing each other as shown in FIG. 5.

A channel 87 is formed by the inner walls of leg portions 70A(1) and 70B(1). Latch 60, seen in FIG. 3, slides in channel 87. Returning again to FIG. 5, the width of the portion of channel 87 separating foot portions 70A(2) and 70B(2) is distance W1 while the width of the portion of channel 87 separating leg portions 70A(1) and 70B(1) is distance W2 as partially shown in FIG. 4 and more clearly in FIG. 5. In this embodiment of the invention, distance W2 is larger than distance W1.

As mentioned earlier, latch 60 slides within channel 87, a portion of latch 60 being situated within width W2 and a portion of latch 60 being situated within width W1, as will be now explained. Referring to FIG. 4 in conjunction with FIG. 5, the latch mechanism is assembled by inserting latch 60 in the direction of arrows 85 into the channel 87 formed by latch guides 70A and 70B. Latch 60 includes a latch main body portion 90 exhibiting a width equal to T2, where T2 is approximately the same dimension as latch channel dimension W2. Latch 60 further includes a flexible portion 95 having a width equal to T1 which is substantially the same as width W1 separating foot portions 70A(2) and 70B(2) of the L shaped latch guides 70A and 70B. Flexible portion 95 is capable of bending with respect to the main body portion 90 to which flexible portion 95 is attached. In actual practice, dimensions T1 and T2 are sufficiently smaller than dimensions W1 and W2, respectively, to permit latch 60 to slide relatively freely within latch guide way 70.

It is shown in FIG. 3 and more clearly by FIG. 4 that latch main body 90 fits within the wider portion of channel 87 of width W2 which separates leg portions 70A(1) and 70B(1). The latch flexible portion 95, however, fits within the narrower portion of channel 87 of width W1 which separates foot portions 70A(2) and 70B(2). Width W1 is sufficiently smaller than width W2 so that latch 60 is captivated within latch guide way 70 by foot portion 70A(2) and 70B(2). The travel of latch 60 within latch guide way 70 is thereby restricted to motion substantially in the direction of arrow 85 or in a direction substantially opposite to arrow 85, namely in a direction parallel to the lengthwise dimension of channel 87.

Returning now to the cross sectional view of FIG. 3, latch 60 is seen fully inserted into latch guide 70. Latch flexible member 95 includes opposed ends 95A and 95B of which end 95A is attached to latch main body 90, the remaining end being end 95B. A protrusion 100 at end 95B of latch flexible portion 95 abuts latch guide cross member 80 to prevent further travel of latch 60 in the direction of arrow 85. More specifically, protrusion 100 includes a first surface 100A which faces and abuts a first surface 80A of the latch guide cross member 80 to prevent the latch 60 from sliding in a direction substantially that of arrow 85. This restriction of travel in the direction of arrow 85 by the abutment of protrusion 100 on latch guide cross member 80 provides part of the aforementioned latch dual locking feature as will be discussed in more detail subsequently.

As seen in FIG. 3, main body portion 90 includes opposed ends 90A and 90B. Main body portion 90 further includes a latch bolt portion 105 at end 90B. Latch bolt portion 105 engages latch receiving member 65 to hold hinged door 45 in the closed position when door 45 is swung down to cover front panel surface 15A. More specifically, at the urging of the user, latch bolt portion 105 slides into and is received by opening 67 (see FIG. 1) of latch receiving member 65.

Furthermore, protrusion 100 of latch flexible portion 95 abuts latch guide cross member 80 so that latch 60 is locked in a shock and vibration resistant manner. Any force that may be applied to bolt portion 105 of latch 60 in the direction of arrow 85 is resisted by latch guide cross member 80 contacting protrusion 100 of latch flexible portion 95. The latch bolt portion 105, thus, can not be retracted into latch guide way 70 until the locking feature represented by cross member 80 blocking protrusion 100 is released. The manner in which the locking feature is released will be discussed later.

Continuing now with the exploded view shown in FIG. 4, after latch 60 is inserted into latch guide way 70, a retaining pin 110 is frictionally inserted into a hole 115 in left latch guide 70A. Retaining pin 110 extends into a groove 120 formed in side surface 90C of latch main body portion 90 and prevents latch 60 from being removed in the direction substantially opposite to arrow 85 when latch 60 is operated with hinged door 45 open. That is, when hinged door 45 is open, latch receiving member 65 does not prevent latch 60 from being removed from latch guide way 70, but pin 110 within groove 120 does prevent latch 60 from being so removed.

In this embodiment of the invention, retaining pin 110 in hole 115 of left latch guide 70A in cooperation with groove 120 of latch main body portion 90 restricts the range of motion of latch 60 within guide way 70 to just that necessary to operate the latch mechanism. Groove 120 includes a groove end 120A which forms a stop beyond which latch 60 can not move when latch 60 is urged in the direction opposite of arrows 85 such that groove end 120A comes in contact with retaining pin 110. Latch 60 is consequently captured within latch guide way 70 by latch guide cross member 80 at one end of the latch guide way 70 and by retaining pin 110 at the other end of the latch guide way 70. Latch 60 is further captured against hinged door 45 by the aforementioned inverted L shaped latch left and right guides 70A and 70B.

It will be appreciated by those skilled in the art that numerous other embodiments of retaining pin and groove arrangements could be implemented. For example, a retaining pin, pin hole and latch body groove can occur on the right side latch guide 70B, or on both the left and right latch guides 70A and 70B. These alternate embodiments can be used with substantially similar effect as provided herein by retaining pin 110 in hole 115 of left latch guide 70A operating in groove 120 of latch 60. Moreover, it will also be appreciated that changing the location of hole 115 with respect to groove end 120A may be used to alter the extent of the travel of latch 60 as may be desired in other embodiments of the invention.

In order to accommodate the disassembly of the latch mechanism as seen in FIG. 4, a hole 125 is provided within groove 120 of latch 60 so that when hole 125 of latch 60 is aligned with hole 115 of latch guide way 70, the retaining pin 110 may be pushed into hole 125 until it is clear of latch guide way 70A. Then, while the hinged door 45 is opened and clear of latch receiving member 65, latch 60 can be removed from latch guide 70 by urging latch 60 in a direction substantially opposite to that of arrow 85.

The operation of the latch mechanism can best be described by reference to the cross sectional view of FIG. 3. Latch 60 is shown with bolt portion 105 of latch 60 engaged within opening 67 of U-shaped latch receiving member 65. Latch receiving member 65 and opening are best observed in FIG. 1. Continuing again with FIG. 3, protrusion 100 on latch flexible portion 95 abuts cross member 80 (visible in FIG. 4) which prevents latch 60 from moving in the direction of arrow 85. As seen in FIG. 4, the tip of bolt portion 105 at end 90B is sculpted and angled to permit easy insertion of bolt portion 105 into latch receiving member 65.

The unlocking and opening of the latch mechanism is best seen in FIG. 3. When a force is applied to the flexible portion 95 substantially in the direction of arrow 135 shown in FIG. 3, latch flexible portion 95 flexibly bends allowing protrusion 100 to slip under latch guide cross member 80 so as to disengage the aforementioned locking feature. Latch 60 is now free to move within latch guide way 70 in the direction of arrow 85 sufficiently far to allow latch bolt 105 to clear and disengage latch receiving member 65.

In more detail, latch flexible portion 95 forms a gap 130 with latch body portion 90 when the latch protrusion 100 abuts the latch guide cross member 80 as seen in FIG. 3. When a force is applied by the user to latch flexible portion 95 in a direction substantially the same as that of arrow 135, latch flexible portion 95 bends towards latch main body portion 90, closing gap 130 thus allowing latch protrusion 100 to slip under latch cross member 80. Latch flexible portion 95 includes a ramp portion 140 to which the user applies a force to slide latch 60 back and forth within latch guide way 70. Ramp portion 140 is slanted as shown in FIG. 3 and discussed later. The slanted ramp portion 140 of latch flexible portion 95 transfers a component of the force applied in the direction of arrow 135 into a force in a direction substantially the same as arrow 85. With the latch locking feature released, and with a component of force applied in the direction of arrow 85, latch 60 slides within latch guide way 70 to the open position shown in the cross sectional drawing of FIG. 6A.

Figure 6A:
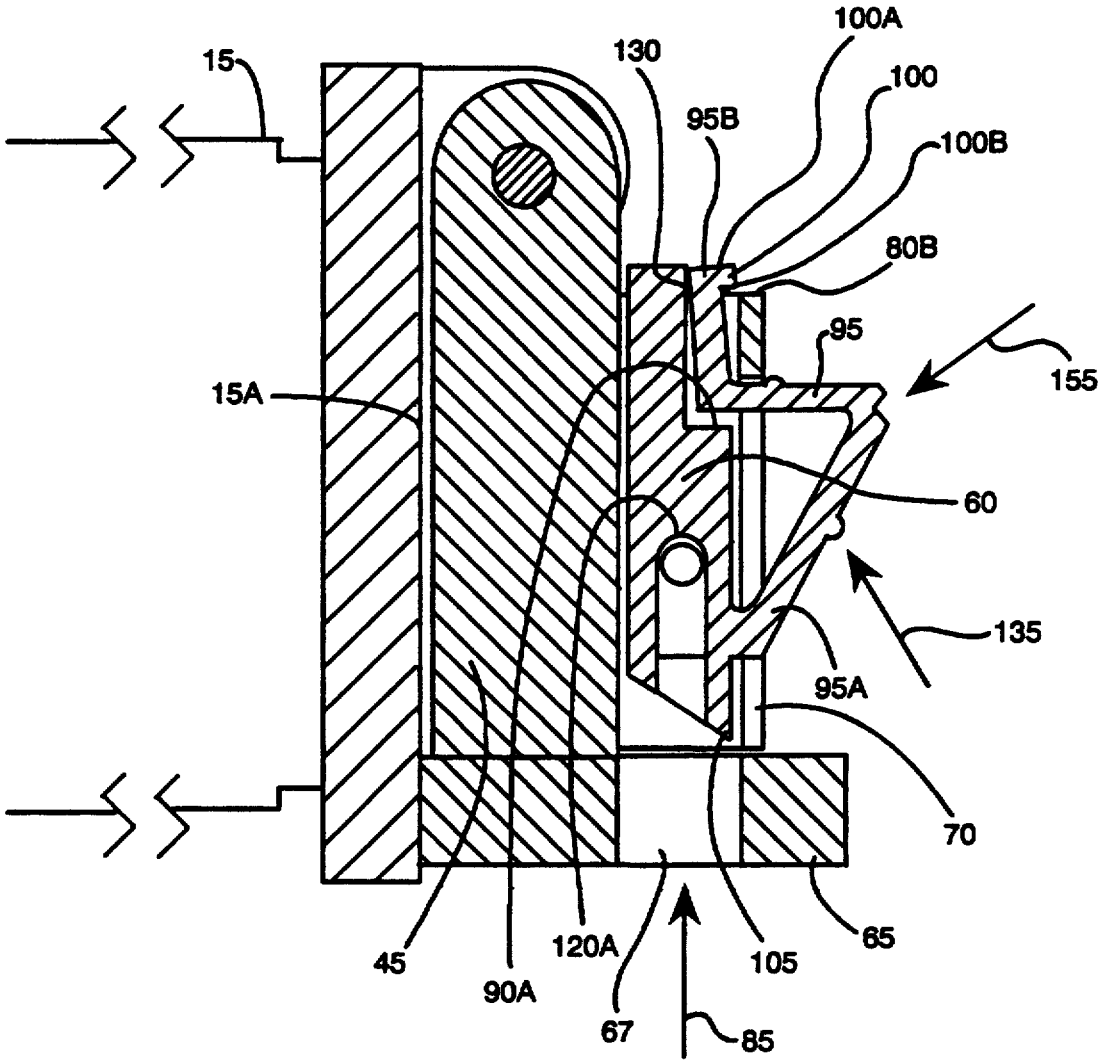
FIG. 6A is a sectional view of the latch mechanism with the latch in the opened position, the section being taken at line A—A of FIG. 2, such latch exhibiting a dual locking feature.

FIG. 6A shows a cross sectional view of the open latch along section lines A—A of FIG. 2. That is, FIG. 6A is the same view as FIG. 3, except that latch 60 is shown in the open position in FIG. 6A. As seen in FIG. 6A, latch bolt portion 105 is fully retracted from latch receiving member 65 and the hinged door 45 can now be swung open.

In one embodiment of the invention, a second surface 100B of protrusion 100 at end 95B of latch flexible portion 95 abuts and catches on a second surface 80B of latch guide cross member 80 when the latch is fully retracted in the open position as shown in FIG. 6A. Latch 60 is thereby locked in the open position so that latch 60 does not inadvertently interfere with latch receiving member 65 when door 45 is being swung open and closed. That is, latch 60 is locked in a "latch open" position with bolt portion 105 fully retracted within latch guide way 70.

The latch mechanism may be closed by applying a force in a direction substantially the same as arrow 155 of FIG. 6A. That force closes the gap 130 which allows surface 100B of protrusion 100 to release from surface 80B of guide cross member 80. A component of the force applied in direction 155 is transferred in a direction substantially opposite to arrow 85 allowing the latch 60 to slide within latch guide way 70 to the closed position shown in FIG. 3. That is, latch 60 is locked in a "latch closed" position with bolt portion 105 fully extended into opening 67 of latch receiving member 65, and with surface 100A of protrusion 100 in contact with and blocked by cross member surface 80A.

From the above, it will be appreciated that the embodiment of the latching mechanism of the invention described above and shown in FIG. 3 and FIG. 6A exhibits a dual lock feature. That is, latch 60 is capable of being locked in a "latch open" position and in a "latch closed" position.

Figure 6B:
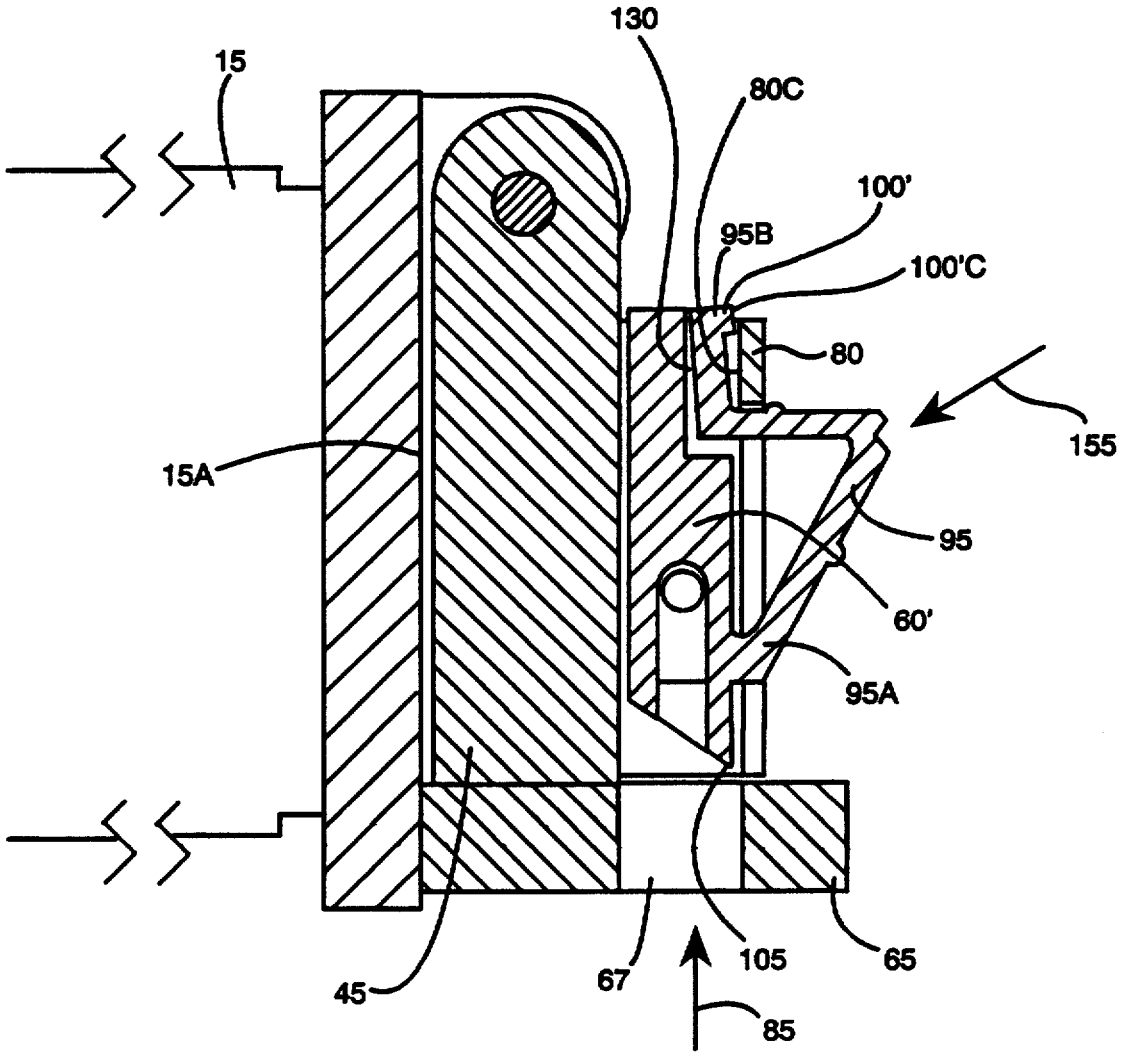
FIG. 6B is a sectional view of the latch mechanism with the latch in the opened position, the section being taken at line A—A of FIG. 2, such latch exhibiting a single locking feature.

In another embodiment of the invention shown in FIG. 6B, the latching mechanism of the invention exhibits a single lock feature in which latch 60' is capable of being locked in a "latch closed" position as now described. In FIGS. 6A and 6B, like numbers are used to indicate like elements. Latch 60' of FIG. 6B is similar to latch 60 of FIG. 6A, except for the modification that protrusion 100' at end 95B of latch flexible portion 95 is shaped to remain under latch guide crossmember 80 when latch 60' is fully retracted or in the open position. More specifically, protrusion 100' and cross member 80 are shaped such that protrusion 100' remains in contact with cross member surface 80C as latch 60' slides within latch guide way 70. Latch 60' is frictionally retained in the "latch open" position by contact with guide way 70 when bolt portion 105 of latch 60' is fully retracted within latch guide way 70. At the same time it is noted that latch 60' is still relatively freely movable within latch guide way 70 at the urging of the user.

The latch mechanism shown in FIG. 6B may be closed by applying a force in a direction substantially the same as arrow 155 of FIG. 6B. That force overcomes the above mentioned friction. A component of the force applied in direction 155 is transferred in a direction substantially opposite to arrow 85 allowing latch 60' to slide within latch guide way 70 to the closed position shown in FIG. 3. That is, latch 60' is locked in a "latch closed" position with bolt portion 105 fully extended into opening 67 of latch receiving member 65, and with surface 100A of protrusion 100 in contact with and blocked by cross member surface 80A.

Latch 60 of FIG. 3 and FIG. 6A and its operation are now described in more detail together with a summary of latch operation. FIG. 3 shows latch 60 as including the aforementioned latch flexible portion 95 which extends from latch main body portion 90 along ramp portion 140 at an acute angle 145 with respect to latch main body portion 90. The user applies an operative force to ramp portion 140 of latch flexible portion 95 substantially in the direction of arrow 145 to unlock and open latch 60. In the preferred embodiment of the invention, acute angle 145 is approximately equal to 33 degrees, but alternative embodiments are contemplated with different values of angle 145.

Flexible portion 95 includes a right angle section having a right angle portion 150 with legs 150A and 150B situated at approximately right angles with respect to each other. As shown in FIG. 3, leg 150A joins ramp portion 140 in a manner that allows leg 150B to remain substantially parallel with latch main body portion 90, forming a gap 130 with latch body 90. The free end 95B of leg 150B includes protrusion 100 which in cooperation with cross member 80 embodies the aforementioned dual locking feature of the latch mechanism.

In this embodiment of the invention, latch main body portion 90 has a varying height as referenced from the front face 45A of door 45. The height of main body portion 90 in the region of gap 130 is less than the height of the remainder of the main body portion 90 as seen in FIG. 3. The height of latch body 90 changes in step-like fashion to form a step 90D on latch main body 90. Other embodiments of the invention are contemplated wherein the height of main body 90 does not change in the step-like fashion referred to above, but rather the step-like structure 90D is replaced with a ramp-like structure, for example, or other suitable geometry which fits within guide way 70. A secondary gap is formed between step 90D of latch main body 90 and leg 150A of latch flexible portion 95. When latch 60 is in the closed and locked shown in FIG. 3, a force substantially in the direction of arrow 85 is resisted by the abutment of protrusion 100 against cross member 80 causing flexible portion 95 to flexibly bend until step 90D contacts leg 150A of latch flexible portion 95. Any additional force substantially in the direction of arrow 85 is resisted by the abutment of step 90D and leg 150A so that latch flexible portion 95 is prevented from excessive bending. Excessive bending of latch flexible portion 95 could result in undesirable permanent deformation or breakage and is advantageously avoided in the above described manner.

As mentioned earlier, FIG. 6A shows the latching mechanism in with latch 60 unlatched or in the open position. That is, latch 60 is withdrawn from opening 67 of latch receiving member 65. The latching mechanism is unlocked and latch 60 is closed by applying a force to latch flexible portion 95 substantially in the direction of arrow 155 as shown in FIG. 6A. FIG. 6A shows the position latch flexible portion would assume momentarily after such force is applied in the direction of arrow 155. That is, a user applied force substantially in the direction of arrow 155 causes flexible portion 95 of latch 60 to flexibly bend and close gap 130. Surface 100B of protrusion 100 is disengaged from face 80B of cross member 80 and latch 60 is free to slide to the closed and locked position. A component of the force applied substantially in the direction of arrow 155 is directed by latch flexible portion 95 to latch main body 90 along a direction substantially opposite to arrow 85 causing latch 60 to travel within guide way 70 in a direction substantially opposite to arrow 85.

Latch retaining pin 110 operating in latch groove 120 acts to restrict the motion of latch 60 within latch guide way 70 and prevents latch 60 from sliding free of the latch guide 70 if the latch 60 should be operated with the door 45 swung open and clear of latch receiving member 65. When hinged door 45 is swung closed against front face 15A of housing 15, however, latch bolt 105 engages latch receiver 65. Latch 60 moves in a closing direction substantially opposite to arrow 85 sufficiently far to permit surface 100A of protrusion 100 to engage face 80A of cross member 80 and thereby lock the latch 60 in a closed position. In this manner, the latch 60 is placed in the closed and locked position.

Returning now to FIG. 2, housing 15 of apparatus 10 is shown with door 45 swung closed and covering electronic module 25 which is fully inserted into opening 20 of housing 15. Hinged door 45 preferably has a gasket (not shown) and when swung to a closed position provides a sealed, substantially dust free, and moisture resistant environment within which module 25 may be operated inside housing 15 of apparatus 10. In this embodiment of the present invention, electronic module 25 contains electronic memory circuitry of the type used in computer applications. When operatively inserted into opening 20 of housing 15, the electronic memory circuitry of module 25 becomes a functional entity within apparatus 10. Various similar modules 25 can be interchangeably inserted into and operated within housing 15 in the normal use of apparatus 10. After module 25 is inserted into housing 15 of apparatus 10, hinged door 45 may be swung closed and locked by engaging latch 60 with latch receiving member 65. The abutment of protrusion 100 with latch guide cross member 80 provides a shock and vibration resistant locking feature to the closed and locked latch mechanism is portrayed in FIG. 3. When hinged door 45 is open, latch 60 assumes another locked position whereby protrusion 100 engages cross member 80 in an alternative manner so that latch bolt 105 does not interfere with the closing of hinged door 45 as explained in detail earlier.

Figure 7:
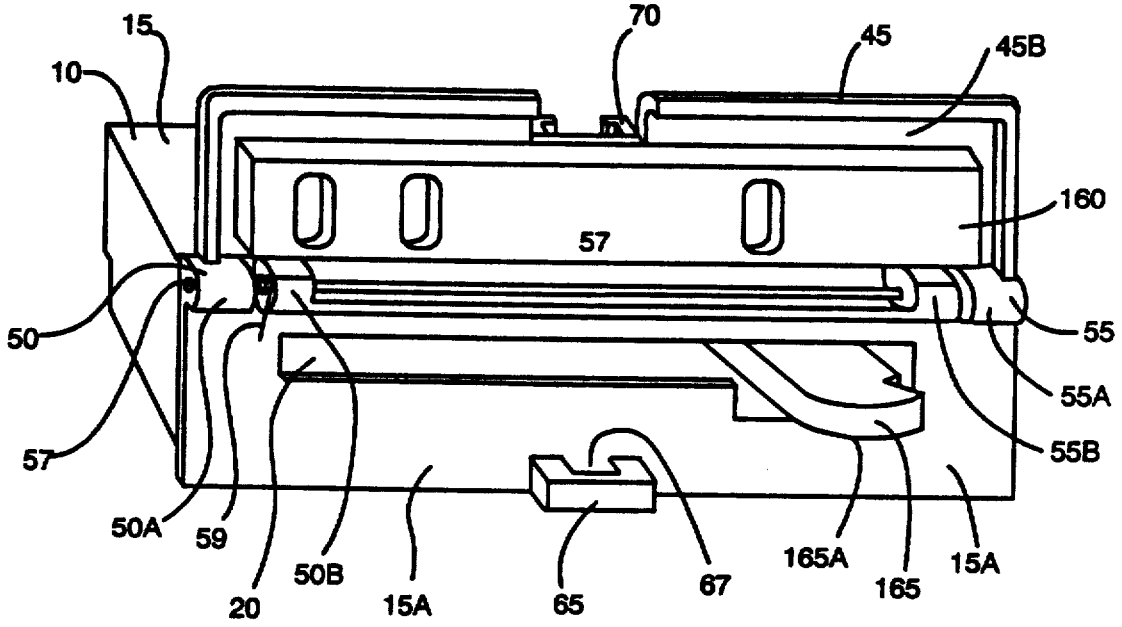
FIG. 7 is a perspective view of the housing closure apparatus of FIG. 1 including a gasket on the housing door.

Latch guide way 70 is advantageously located on the outside surface 45B of door 45 so as not to compromise the sealing integrity of gasket sealing member 160 which is provided on the inside surface 45B of door 45 as shown in the perspective view of FIG. 7. It is this sealing member or gasket 160 in combination with the above described latching arrangement which provides a substantially dust free and moisture resistant environment within housing 15 for the operation of apparatus 10 in combination with removable circuit module 25. When door 45 is closed and latched, sealing member 160 covers and seals opening 20 from the external environment. A module extractor member 165 appears in the rightmost portion of opening 20 in FIG. 7. The protruding end 165A of extractor member 165 extends a relatively small distance beyond front panel surface 15A. Sealing member is fabricated from resilient compressive material such that when door 45 is swung closed and latched, the portion of sealing member 160 which contacts extractor end 165A compresses at such point of contact to complete the seal. It is noted that door 45 is mounted to housing 15 via hinges 50 and 55. Hinge 50 includes hinge portion 50A situated on housing 15 and a hinge portion 50B situated on door 45 as shown. Hinge 55 includes hinge portion 55A situated on housing 15 and a hinge portion 55B situated on door 45. A common shaft 57 extends through hinge portions 50A, 50B, 55A and 55B, all of which are on a common axis, to swingably mount door 45 to housing 15. A spring 59 is positioned on shaft 57 between hinge portions 50A and 50B. The respective ends of spring 59 are situated to contact door 45 and housing front surface 15A so as to bias door 45 in the open position.

The foregoing describes an apparatus for latching a hinged door shut on an apparatus including a housing for an electronic module. The apparatus disclosed provides for latching and unlatching a door latch for keeping a door locked in a closed position against a housing to provide a dust free and moisture resistant environment for the operation of a module within the housing of an apparatus. In one embodiment, the apparatus provides a dual locking capability which locks the latch in a latched position against undesired opening due to shock and vibration, and which also locks the latch in an unlatched position. The disclosed latching mechanism is simple to use and does not require complex hand manipulations. A single finger can be used to easily operate the described latch between the first and second locked positions. The disclosed latching mechanism is well adapted for miniaturization. In another embodiment, the apparatus provides a single locking capability which locks the latch in the latched position against undesired opening due to shock and vibration.

While only certain preferred features of the invention have been shown by way of illustration, many modifications and changes will occur to those skilled in the art. It is, therefore, to be understood that the present claims are intended to cover all such modifications and changes which fall within the true spirit of the invention.

I claim:

1. A housing closure apparatus comprising:

a housing including an opening;

a door including first and second opposed surfaces, the door being swingably mounted on said housing such that said first surface covers said opening when said door is closed, said door exposing said opening when said door is swung open;

a latch guide structure situated on the second surface of said door, said latch guide structure including a channel therein;

a latch receiving member situated on said housing at a location adjacent said latch guide structure when said door is in the closed position;

a slidable latch situated within said channel, said latch including locking means for lockably engaging said latch guide structure in a first locked position when said latch is urged to extend into said latch receiving member;

said latch guide structure including first and second substantially L shaped guide rails, said first and second guide rails each including leg and foot portions, said first and second guide rails being situated on said door in substantially parallel relationship with the foot portion of said first and second guide rails facing each other such that said channel is formed between said first and second guide rails, said first and second guide rails including a common end at which the foot portions of said first and second guide rails are joined together by a cross member therebetween, said channel including an open portion between said cross member and said door;

said latch including a main body portion having a bolt portion at one end thereof, said main body portion being oriented within in said channel such that said bolt portion faces and is engagable with said latch receiving member when said door is closed;

said locking means including a flexible portion having first and second ends, the first end of said flexible portion being attached to said main body portion and being situated within said channel, the second end of said flexible portion being situated adjacent said cross member and engagable with said cross member, said flexible portion including a ramp portion between the first and second ends of said flexible portion, said ramp portion extending from within said channel to without said channel so as to be accessible by a user, said second end of said flexible member being engagable with said cross member in said first locked position when a user urges said ramp portion to cause said bolt portion to extend into said latch receiving member.

2. A housing closure apparatus comprising:

a housing including an opening;

a door including first and second opposed surfaces, the door being swingably mounted on said housing such that said first surface covers said opening when said door is closed, said door exposing said opening when said door is swung open;

a latch guide structure situated on the second surface of said door, said latch guide structure including a channel therein;

a latch receiving member situated on said housing at a location adjacent said latch guide structure when said door is in the closed position;

a slidable latch situated within said channel, said latch including locking means for lockably engaging said latch guide structure in a first locked position when said latch is urged to extend into said latch receiving member and for lockably engaging said latch guide structure in a second locked position when said latch is urged to disengage said latch receiving member;

said latch guide structure including first and second substantially L shaped guide rails, said first and second guide rails each including leg and foot portions, said first and second guide rails being situated on said door in substantially parallel relationship with the foot portion of said first and second guide rails facing each other such that said channel is formed between said first and second guide rails, said first and second guide rails including a common end at which the foot portions of said first and second guide rails are joined together by a cross member therebetween, said channel including an open portion between said cross member and said door;

said latch including a main body portion having a bolt portion at one end thereof, said main body portion being oriented within in said channel such that said bolt portion faces and is engagable with said latch receiving member when said door is closed;

said locking means including a flexible portion having first and second ends, the first end of said flexible portion being attached to said main body portion and being situated within said channel, the second end of said flexible portion being situated adjacent said cross member and engagable with said cross member, said flexible portion including a ramp portion between the first and second ends of said flexible portion, said ramp portion extending from within said channel to without said channel so as to be accessible by a user, said second end of said flexible member being engagable with said cross member in said first locked position when a user urges said ramp portion to cause said bolt portion to extend into said latch receiving member, said second end of said flexible member being engagable with said cross member in said second locked position when a user urges said ramp portion to cause said bolt portion to withdraw from said latch receiving member.

3. A latching mechanism adapted for latching first and second members together, said first and second members including respective edges, said latching mechanism comprising:

a latch guide structure adapted for being situated adjacent the edge of said first member, said latch guide structure including a channel therein;

a latch receiving member adapted for being situated adjacent the edge of said second member at a location adjacent said latch guide structure when said first and second members are brought together;

a slidable latch situated within said channel, said latch including locking means for lockably engaging said latch guide structure in a first locked position when said latch is urged to extend into said latch receiving member;

said latch guide structure including first and second substantially L shaped guide rails, said first and second guide rails each including leg and foot portions, said first and second guide rails being situated in substantially parallel relationship with the foot portion of said first and second guide rails facing each other such that said channel is formed between said first and second guide rails, said first and second guide rails including a common end at which the foot portions of said first and second guide rails are joined together by a cross member therebetween;

said latch including a main body portion having a bolt portion at one end thereof, said main body portion being oriented within in said channel such that said bolt portion faces and is engagable with said latch receiving member;

said locking means including a flexible portion having first and second ends, the first end of said flexible portion being attached to said main body portion and being situated within said channel, the second end of said flexible portion being situated adjacent said cross member and engagable with said cross member, said flexible portion including a ramp portion between the first and second ends of said flexible portion, said ramp portion extending from within said channel to without said channel so as to be accessible by a user, said second end of said flexible member being engagable with said cross member in said first locked position when a user urges said ramp portion to cause said bolt portion to extend into said latch receiving member.

4. A latching mechanism adapted for latching first and second members together, said first and second members including respective edges, said latching mechanism comprising:

a latch guide structure adapted for being situated adjacent the edge of said first member, said latch guide structure including a channel therein;

a latch receiving member adapted for being situated adjacent the edge of said second member at a location adjacent said latch guide structure when said first and second members are brought together;

a slidable latch situated within said channel, said latch including locking means for lockably engaging said latch guide structure in a first locked position when said latch is urged to extend into said latch receiving member and for lockably engaging said latch guide structure in a second locked position when said latch is urged to disengage said latch receiving member;

said latch guide structure including first and second substantially L shaped guide rails, said first and second guide rails each including leg and foot portions, said first and second guide rails being situated in substantially parallel relationship with the foot portion of said first and second guide rails facing each other such that said channel is formed between said first and second guide rails, said first and second guide rails including a common end at which the foot portions of said first and second guide rails are joined together by a cross member therebetween;

said latch including a main body portion having a bolt portion at one end thereof, said main body portion being oriented within in said channel such that said bolt portion faces and is engagable with said latch receiving member;

said locking means includes a flexible portion having first and second ends, the first end of said flexible portion being attached to said main body portion and being situated within said channel, the second end of said flexible portion being situated adjacent said cross member and engagable with said cross member, said flexible portion including a ramp portion between the first and second ends of said flexible portion, said ramp portion extending from within said channel to without said channel so as to be accessible by a user, said second end of said flexible member being engagable with said cross member in said first locked position when a user urges said ramp portion to cause said bolt portion to extend into said latch receiving member, said second end of said flexible member being engagable with said cross member in said second locked position when a user urges said ramp portion to cause said bolt portion to withdraw from said latch receiving member.

* * * * *